United States Patent [19]

Brown

[11] 4,245,965

[45] Jan. 20, 1981

[54] GAS-HANDLING APPARATUS

[75] Inventor: Lester H. Brown, Indianapolis, Ind.

[73] Assignee: Master Air Inc., Indianapolis, Ind.

[21] Appl. No.: 6,537

[22] Filed: Jan. 25, 1979

[51] Int. Cl.[3] ..... F04B 39/14; F04D 29/08; F24F 7/10

[52] U.S. Cl. ..... 417/360; 415/170 A; 415/182; 415/201; 98/43 R; 98/DIG. 7

[58] Field of Search ..... 415/219 C, 201, 170 A, 415/170 R, 182; 417/360, 361, 359; 98/43 R, DIG. 7

[56] References Cited

U.S. PATENT DOCUMENTS

| | | | |
|---|---|---|---|
| 1,850,749 | 3/1932 | Frederick | 415/170 A |
| 2,181,973 | 12/1939 | Jasberg | 417/360 |
| 2,347,386 | 4/1944 | Adams | 415/201 X |
| 2,458,045 | 1/1949 | Angus | 415/201 |
| 2,823,598 | 2/1958 | Jenn | 98/43 R |
| 3,302,547 | 2/1967 | Wasserman | 98/33 |
| 3,305,163 | 2/1967 | Sheppard | 415/201 X |
| 3,425,621 | 2/1969 | Greenheck | 415/219 C X |
| 3,557,681 | 1/1971 | Kritiansen | 98/33 |
| 3,561,793 | 2/1971 | Rode | 285/13 |
| 3,650,633 | 3/1972 | Benoit | 415/219 C X |
| 3,680,894 | 8/1972 | Young | 285/112 |
| 3,698,833 | 10/1972 | Cann et al. | 415/201 |
| 3,712,650 | 1/1973 | Mez | 285/405 |
| 3,738,782 | 6/1973 | Fraser | 415/219 C X |
| 3,871,795 | 3/1975 | Habdo et al. | 415/201 X |
| 4,092,088 | 5/1978 | Nemesi | 415/201 X |

FOREIGN PATENT DOCUMENTS

| | | | |
|---|---|---|---|
| 245200 | 10/1962 | Australia | 98/43 R |
| 785090 | 8/1935 | France | 98/43 R |

*Primary Examiner*—Leonard E. Smith
*Attorney, Agent, or Firm*—Woodward, Weikart, Emhardt & Naughton

[57] ABSTRACT

A gas-handling apparatus includes a housing enclosure having an inlet port and an outlet port which are connected by a duct and blower assembly, wherein the blower assembly draws a gaseous substance from a room or enclosed area and transfers this gaseous substance to another area, such as to the atmosphere. The blower assembly includes a cylindrical arrangement of fan blades attached to a drive shaft which is bearingly supported by a tubular column. This tubular column is rigidly attached to the housing enclosure. The tubular column and drive shaft extend internal to the arrangement of fan blades and the drive shaft is bearingly supported at this internal location. A drive motor is mechanically coupled to the drive shaft in order to rotate the arrangement of fan blades. One end of the duct is attached to the inlet port while the other end of the duct is attached to a duct coupling. This duct coupling serves as an interface between the duct and a tapered shroud member located at one end of the blower assembly. The smaller diameter end of the tapered shroud is concentric to and positioned within the coupling. The shroud, coupling and duct are designed such that the region of their junctions has the shape of a venturi.

17 Claims, 8 Drawing Figures

GAS-HANDLING APPARATUS

BACKGROUND OF THE INVENTION

This invention relates in general to gas-transferring apparata and in particular to ventilating systems for routing a gaseous substance from an enclosed area out to the atmosphere.

Ventilating systems for use in kitchens, lavatories and chemical processing areas are well known in the art. Such systems are used to draw off fumes and odors from within a room or structure and to transfer these fumes and odors to another location such as to the atmosphere. The following list of patents provides a sample of some of the concepts and apparata which have been disclosed.

| Patent No. | Patentee | Issue Date |
|---|---|---|
| 3,712,650 | Mez | 1/23/73 |
| 3,561,793 | Rode | 2/9/71 |
| 3,557,681 | Kristiansen | 1/26/71 |
| 2,823,598 | Jenn | 2/18/58 |
| 3,302,547 | Wasserman | 2/7/67 |
| 3,680,894 | Young | 8/1/72 |

Mez discloses a four-sided flange which is slidable and able to be fastened over the free end of a sheet metal duct. The flange is hollow and has a pair of parallel walls perpendicular to the duct. A solid angle piece is insertable at each corner of the flange into the space between the walls and may be fastened there. The thickness of the angle piece corresponds to the space between the walls. This device pertains primarily to flange connections for ducts which are within a structure and does not disclose a complete ventilating system.

Rode discloses the combination of a seal element and a spacer member for use between a pair of parts which confine a fluid passageway. The seal element sealingly engages the parts and this sealing effect is enhanced by an overpressure inside the seal element. The spacer member surrounds the seal element on the outside and limits the compression of the seal element when the parts are connected together. Sealing efficiency is supposed to be maintained by the presence of a pressure differential across the seal ring. Although this patent discloses means for joining members together, the nature of the art involved does not pertain to ventilating system designs.

Kristiansen discloses a fan for the ventilation of buildings, stables and the like which comprises two concentric tubes in which two sets of interconnected concentric fan vanes are disposed so as to perform an injection of air through the outer tube and an exhaust of air through the inner tube. The fan ventilation system disclosed is designed to control the quantity of air injected without the drawbacks of fans running jerkily and noisily. The design concentrates on the throttling and damper arrangement in order to achieve this objective.

Jenn discloses a ventilator and in particular a fan assembly adapted for mounting exteriorly of buildings where the waterproof housing for the fan motor must not only shed rain but must also provide an unrestricted port for the egress of a fast moving stream of air propelled by the fan. A primary objective of this ventilator is to materially reduce the noises that emanate from conventional units by means other than the normally used soft rubber damping pads. The patent focuses on the specific design of the hood and air bowl arrangement and their specific geometric shapes. Although somewhat remote from applicant's disclosed device, this patent represents the closest art of which applicant is aware.

Wasserman discloses a general purpose portable room with ventilating means mounted thereon. This patent pertains primarily to room construction and possible applications for portable, prefabricated enclosures. Although a ventilating means is provided as part of the patent, the ventilator design itself does not disclose any novel idea.

Young discloses a joint between the ends of two pipes which have different diameters and the joint is formed by a clamp type segmental coupling which engages grooves in the surfaces of the ends of each of the two pipe members. This joint design is applicable for pipes with two different outside diameter measurements, but the concepts disclosed by this patent are not believed to be relevant to the ventilating system art.

It is important in ventilating system design that the air flow rate be maximized for a particular size unit and for a particular system cost. For a certain fan size and motor rating a theoretical maximum flow rate can be computed; however, in actual use system inefficiency, such as leakage, friction and interference, will reduce this theoretical maximum to some lower value.

One approach is to closely tolerance all component pieces so that there is virtually no leakage of air between parts. Of course, if the fan is rigidly attached to other parts and to the enclosing housing in order to accomplish this "air-tight" arrangement, it may not be possible, without a complete overhaul, to clean the fan blades of grease or other buildup which will ultimately result in an inoperable system. Furthermore, the results of such a close toleranced system may not be worth the cost.

Another approach is to relax the part tolerances and provide for various clearances, such as between the fan assembly and the duct through which air is drawn by the fan assembly. If there is too much clearance there can occur internal flow loops where exhaust air is continuously recycled and never exited. This will reduce the maximum flow rate possible and lower system efficiency.

The larger the ventilating system becomes, the more pronounced these disadvantages become. Therefore, it would be a significant improvement if a ventilating system could be designed having a large-volume flow rate, moderate tolerances, virtually no internal flow loops and means to conveniently clean the fan blades.

SUMMARY OF THE INVENTION

A gas-handling apparatus according to one embodiment of the present invention comprises a housing enclosure portion including an inlet port and an outlet port, an arrangement of fan blades having a generally cylindrical shape and being disposed within the housing enclosure, a drive shaft attached to the arrangement of fan blades, a drive motor coupled to the drive shaft, and a segmented inlet duct member. The segmented inlet duct member comprises a connecting duct portion, coupling means attached to the connecting duct portion and a tapered shroud member having a larger diameter end attached to the arrangement of fan blades and a smaller diameter end positioned within the coupling means.

One object of the present invention is to provide an improved ventilating device.

Related objects and advantages will be apparent from the following description.

DESCRIPTION OF THE PREFERRED EMBODIMENT

Figure 1:
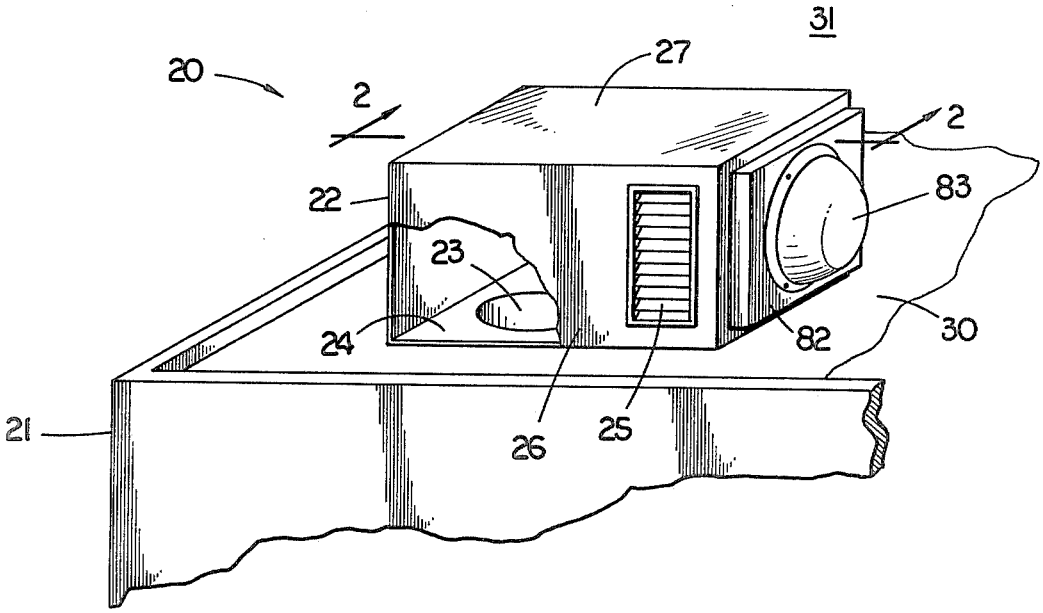
FIG. 1 is a fragmentary perspective view of a gas-handling apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 gas-handling apparatus 20 is illustrated as it would be when positioned atop a structure 21 which may be for example, a house, restaurant or similar building. Apparatus 20 includes a sheet metal housing enclosure 22 with an inlet port 23 at one end in base surface 24 and an outlet port 25 at the opposite end in either the top surface or one of the two side panels. Outlet port 25 is illustrated as a louvered, generally rectangular vent and is positioned in side panel 26. The louvers exclude rain and snow, but it should be understood that if located in the top surface 27, the design of port 25 might have to be changed slightly in order to continue to restrict the entry into apparatus 20 of such forms of moisture. There are various hood and cap designs well suited for this purpose and further description of such items is unnecessary.

Figure 2:
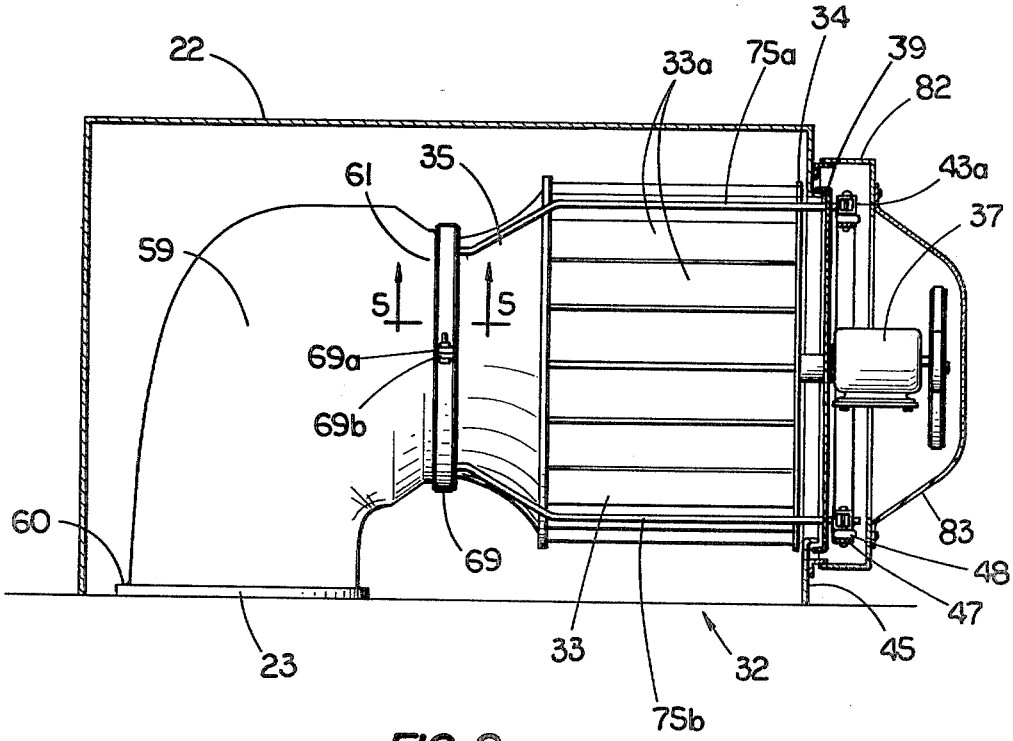
FIG. 2 is a section view of the FIG. 1 apparatus taken along line 2—2 in FIG. 1.
Figure 3:
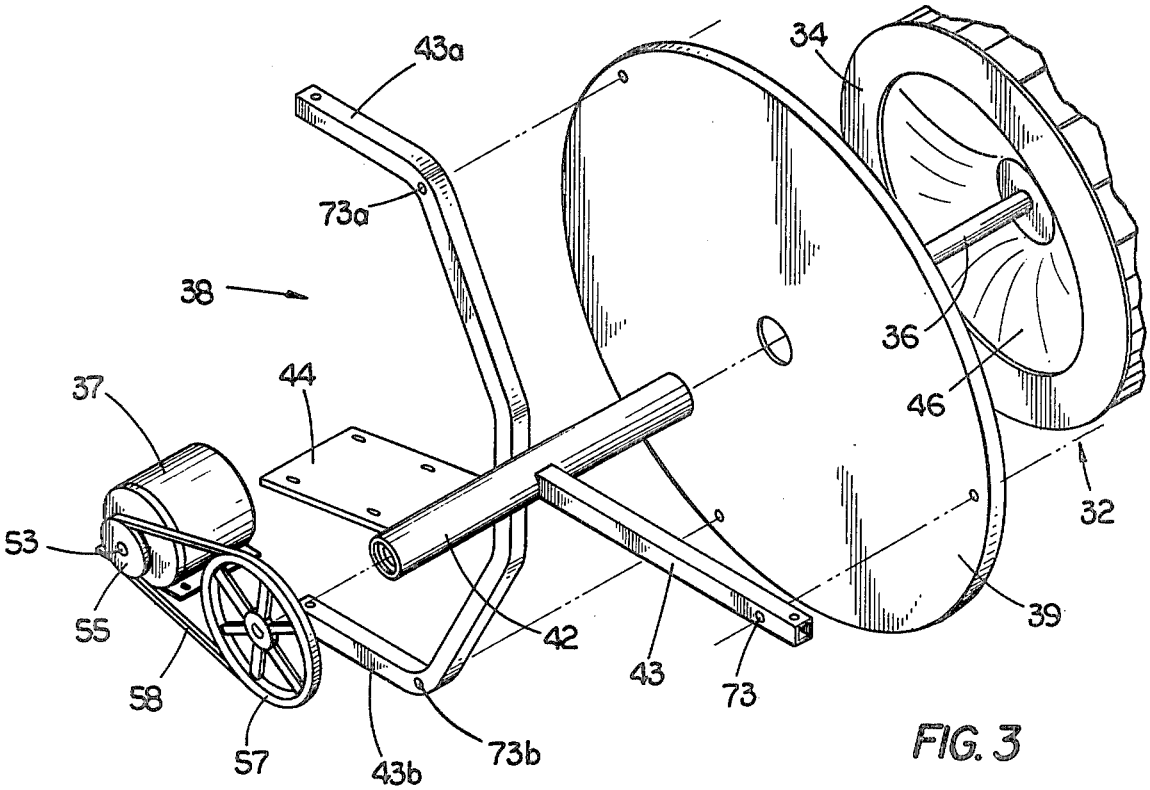
FIG. 3 is an exploded view of a blower assembly comprising a portion of the FIG. 1 apparatus.

Inlet port 23 is aligned with a similarly sized opening in roof portion 30 of structure 21 and there may be additional duct work coupling inlet port 23 with the area or room which is to be ventilated by the removal of a gaseous substance such as, smoke. For example, if apparatus 20 is used to transfer fumes, smoke or odors from within a kitchen to the atmosphere 31 then a stove hood and the necessary ducting would likely be used in order to trap such gaseous substances as they are generated and to funnel them into a single duct passageway with an escape path to the atmosphere through apparatus 20. These gaseous substances are drawn up through this duct passageway by the action of blower assembly 32 (see FIG. 2), and are transferred through outlet port 25 into the atmosphere 31. Apparatus 20 may be secured to roof portion 30 by suitable mechanical means such as brackets and threaded fasteners so as to be rigidly attached and not affected by such environmental conditions as strong winds. Apparatus 20 may be of a variety of sizes depending upon the desired cubic feet/minute volume transfer rate, but even the larger sizes remain relatively lightweight due to the sheet metal construction and the design of the blower assembly.

Figure 4:
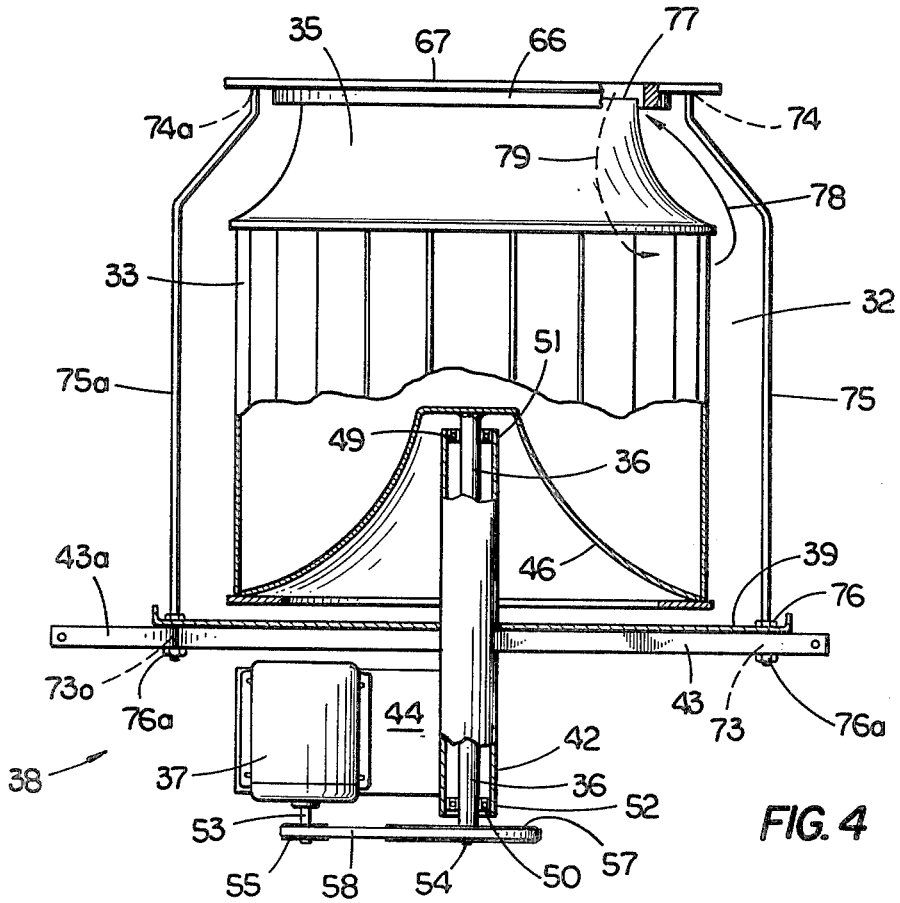
FIG. 4 is a plan view of the FIG. 3 assembly with portions in section to show internal features.
Figure 6:
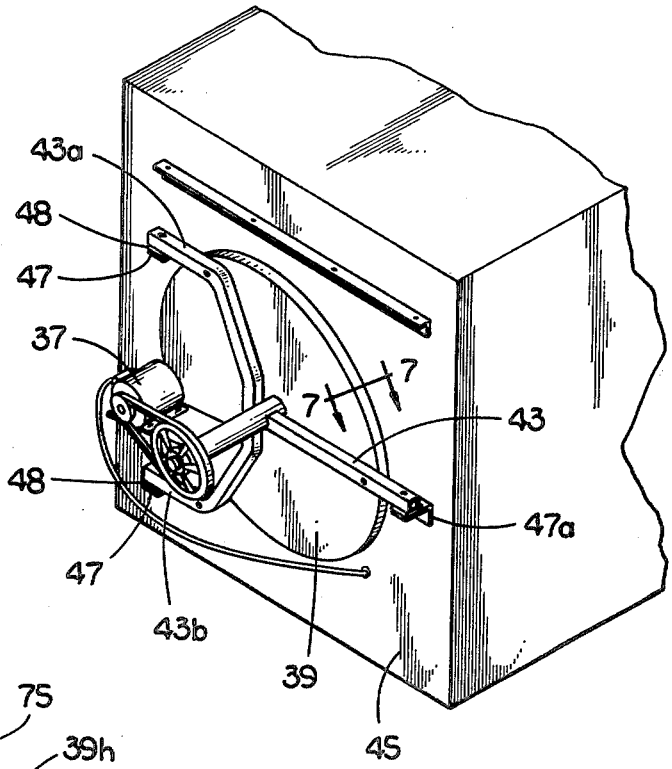
FIG. 6 is a partial perspective view of the FIG. 3 assembly as mounted to one end of a housing which comprises a portion of the FIG. 1 apparatus
Figure 8:
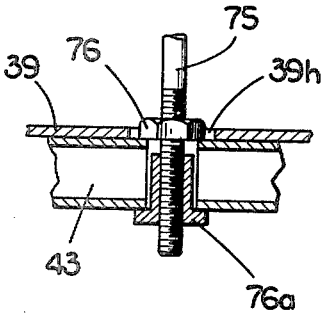
FIG. 8 is a partial section view of the rod and arm assembly of FIG. 4.
Figure 7:
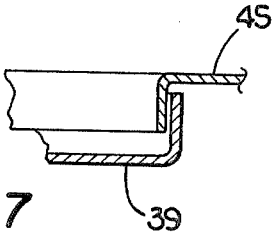
FIG. 7 is a partial section view of a lid and housing taken along line 7—7 in FIG. 6 and comprising a portion of the FIG. 1 apparatus.

Blower assembly 32 includes a blower wheel 33 which includes a generally cylindrical arrangement of fan blades 33*a* and the individual fan blades are attached between a top cover 34 and a blower wheel tapered shroud 35, such as by welding or other suitable metal-to-metal joining techniques. The entire blower wheel 33 is attached to and rotated by drive shaft 36 (see FIG. 4) in combination with drive motor 37. The positioning and alignment of the motor, drive shaft and blower assembly 32 relative to housing enclosure 22 is accomplished in part by the use of a unique mounting structure 38 which is hinged to the enclosure 22. Structure 38 includes a tubular support column 42, three arms 43, 43*a* and 43*b* and motor platform 44, all of which are joined together by a suitable method, such as welding, in order to form a single integral member. Support column 42 extends through lid or door member 39 and through an open region in top cover 34 such that one end of support column 42 is located in the center region of the fan blades 33*a*. Arms 43*a* and 43*b* are hinged at their outermost ends to brackets 47 affixed to end 45 of housing enclosure 22. Brackets 47 (FIGS. 2 and 6) are fitted with shock-absorbing pads 48. This arrangement tends to insulate any motor and fan oscillation and vibration from the housing enclosure. The outermost end of arm 43 is bolted or pinned to bracket 47*a* affixed to housing 22 to serve as a support and latch which may be released in order to pivotally open member 39 in order to expose blower assembly 32 and in order to gain access to the interior of enclosure 22. When arm 43 is latched, the three arms hold member 39 tight against a flanged opening in the end of the housing and maintain this closed and sealed condition until unbolted or unpinned. Motor platform 44 extends outwardly from support column 42 and is slotted at four mounting locations so that the motor mounting position is adjustable. Such adjustment may be necessary in order to either increase or decrease the belt tension between the motor and the drive shaft as will be described hereinafter.

The inner region of the blower wheel 33 and fan blades 33*a* includes a frustoconical surface 46 to which drive shaft 36 is rigidly attached. Any one of a number of methods of joining drive shaft 36 to frustoconical surface 46 are acceptable such as, for example, mechanical fasteners or welding. The primary concern in the joining of drive shaft 36 to frustoconical surface 46 is that their particular connection be strong and arranged in such a manner so as to prevent slippage of one member relative to the other under conditions of fan blade rotation.

Drive shaft 36 is bearingly mounted within tubular support column 42 by means of bearings 49 and 50 positioned at ends 51 and 52, respectively, of support column 42. The position of bearing 49 is internal to blower wheel 33 and this location assures that there will be virtually no cantilevering effect by drive motor 37 relative to blower assembly 32 and this will reduce the vibration caused to the fan blades 33*a* by the action of motor 37. The output shaft 53 of motor 37 is coupled to the outermost end 54 of drive shaft 36 by means of pulleys 55 and 57 in combination with V-belt 58. As motor 37 is operated, the rotation of output shaft 53 will be transferred to the blower wheel 33 and fan blades 33*a* by means of drive shaft 36, the drive shaft and blower wheel being free to rotate while lid member 39 and mounting structure 38 remain stationary. Fan blades 33*a* each have an arcuate shape and are welded between top cover 34 and surface 46 and shroud 35 in a backwardly curved circular array and, as the blades rotate, a pressure differential develops causing air, or any other gaseous substance which may be present, to be drawn up through shroud 35 and propelled outwardly through the sides of blower wheel 33. This outwardly propelled air, or other gaseous substance, is restricted to a single escape path to the atmosphere, that being by way of outlet port 25, due to the enclosed nature of housing enclosure 22. Filtering can be employed, if desired, depending upon the particular application and gaseous substance present.

In order to achieve high volume gas transfer it is necessary to effectively seal the gas passageway so that the vacuum created by blower wheel 33 is maximized. In order to effect the transfer of the gaseous substance from a room or other enclosed area to the atmosphere, duct member 59 is provided internal to enclosure 22 and has a first end 60 which is assembled by means of a rigid coupling to inlet port 23 and completely seals around inlet port 23 so that any potential gas leakage at that point is eliminated. Similarly, apparatus 20 is arranged relative to roof portion 30 so that inlet port 23 can be sealed with whatever duct work is within the particular structure. Although that portion of the passageway from within structure 21 to the atmosphere 31 which includes duct member 59 and inlet port 23 can be effectively sealed, there must be at some location, clearance between the rotating blower wheel and the stationary duct work. This clearance location has a significant effect on the design and performance of apparatus 20 in that it represents a source of leakage and any leakage reduces efficiency. A further concern is that there be some way of inspecting, cleaning and/or repairing the blower assembly 32, especially the fan blades 33*a* and other internal portions, without requiring a complete disassembly of apparatus 20. By providing a hinged arrangement of lid member 39 to enclosure 22 and by mounting blower assembly 32 onto lid member 39 as has been described, those concerns about fan blade inspection, blade cleaning and repairing and other general repair work are accounted for. Similarly, in order to achieve an effective, close tolerance coupling between the rotating shroud 35 and the stationary end 61 of duct member 59 a unique coupling arrangement is incorporated which permits blower assembly 32 to be pivotally separated from enclosure 22 while at the same time establishing a close fitting orientation relative to duct member 59 so that the flow of any gaseous substance through this duct passageway is optimized and any loss through leakage is virtually eliminated. A further feature of this coupling arrangement permits the use of lightweight, sheet metal parts while still achieving very high volumetric flow rates.

Figure 5:
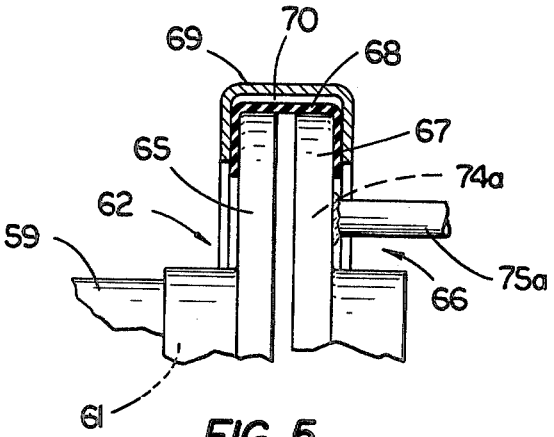
FIG. 5 is a partial section view of a flexible coupling seal means taken along line 5—5 in FIG. 2 and comprising a portion of the FIG. 1 apparatus.

Welded to end 61 of duct member 59, or rigidly attached thereto by any one of a number of suitable means, is a flanged ring member 62 (see FIG. 5) which has a radially extending flange 65 at one end. Aligned with ring member 62 is a second flanged ring member 66 of substantially identical size and shape to ring member 62. The flange 67 of ring member 66 is disposed adjacent to flange 65 and the separation between abutting faces of flanges 65 and 67 of ring members 62 and 66, respectively, is effectively sealed by means of a flexible, elastomeric band 68, such as a large-diameter, wide rubber band which must be stretched in order to fit around the outer circumference of flanges 65 and 67. Band 68 provides a suitable sealing between the two ring members and prevents the leakage of any gaseous substance around this ring member interface when such substance is being transferred through duct member 59 into blower assembly 32. Encircling the outer circumference of flanges 65 and 66 and overlapping their outwardly facing surfaces adjacent the outer circumference edges is a circular metal retainer 69 which has a trough or channel-like cross-sectional shape suitably sized for the outer portions of flanges 65 and 67 to fit therein. Retainer 69 has outwardly turned tab portions 69*a* and 69*b* (FIG. 2) at opposite ends and these tab portions are drawn together by means of threaded fasteners thereby providing a coupling design which completely seals around the two ring members and securely holds the seal in place while at the same time being designed to accommodate dimensional variations and slight oscillatory movement which may occur between the two ring members. The accommodation of these dimensional shifts and slight movement being accomplished by the flexible seal and clearance depth designed into trough portion 70 of retainer 69. This coupling cooperates with the blower wheel shroud 35 and the inlet duct 59 to provide the floating venturi of the present invention.

Ring member 66 is primarily supported by arms 43, 43*a* and 43*b*. Holes 73, 73*a* and 73*b* are located in each of these arms at a greater radial distance from the axis of drive shaft 36 than the radius of blower wheel 33. Three corresponding holes 74, 74*a* and 75*b* in flange 67 have the same angular spacing as holes 73, 73*a* and 73*b* but are located closer to the axis of drive shaft 36. Extending between corresponding pairs (73–74, 73*a*–74*a* and 73*b*–74*b*) of holes are three, inwardly bent metal rods 75, 75*a* and 75*b*. These metal rods are rigidly attached at one end into the holes in flange 67 and the opposite ends of each of these three rods are externally threaded and fastened to arms 43, 43*a* and 43*b* by means of hex head locator nuts 76 and sleeve nuts 76*a*. By correct location of the locator nuts 76 on the respective rods, and jamming the nuts 76 and 76*a* against the arms when nuts 76*a* are tightened against them when the arm 43 has been latched, ring member 66 is held in a fixed position axially relative to the blower wheel and relative to ring 62. Clearance holes 39*h* in door 39, accommodate nuts 76 at this time. When the nuts 76*a* are removed and arm 43 unlatched, lid member 39 can be pivotally opened without disturbing the rods or the coupling of ring members 62 and 66 and this ring coupling thus remains attached as part of duct member 59. In this manner, that portion of the blower assembly which is internal to housing enclosure 22 can be removed from housing enclosure 22 without disturbing the coupling of the two ring members which are disposed between shroud 35 and duct end 61.

The smaller diameter end 77 of shroud 35 fits within ring 66 and is generally concentric thereto. The object of the design of shroud 35 and the mechanical construction described is to minimize the clearance between the inner diameter surface of ring 66 and the outer surface of shroud 35 so that any loss of the gaseous substance being transferred will be kept to a minimum. If the clearance between these members is excessive then an internal looping flow pattern may develop wherein the gaseous substance being pulled through duct member 59 for exhausting to the atmosphere out the sides of blower wheel 33 will return through the separation between shroud 35 and end 61 and be reintroduced into blower wheel 33. This cyclic or circular pattern is illustrated by arrows 78 and 79 (FIG. 4) and if such a pattern occurs the same portion of gaseous substance will continuously be cycled and this will reduce the volumetric flow rate of the gaseous substance actually being exhausted to the atmosphere and thus reduce the efficiency of apparatus 20. The solution to this problem is to position shroud 35 within ring member 66 such that there is a minimum amount of clearance between the two so that there will not be suitable clearance between the shroud and the ring for such a cyclic flow pattern to develop. However, if when positioning shroud within ring 66 the clearance is too small, then any out of round condition or dimensional variation present between drive shaft 36 and blower wheel 33 may cause, in combination with motor vibration, shroud 35 to hit or vibrate against ring 66 which is undesirable both because of the noise which will be caused and because of the accelerated wear which will be caused to the component parts of apparatus 20. The arrangement of outer end 61 effectively coupled to shroud 35 by means of the coupling which includes rings 62 and 66 has a passageway geometry with a venturi shape, with the constricted region being at smaller diameter end 77 of shroud 35.

The design of apparatus 20 as disclosed herein optimizes the clearance between shroud 35 and ring member 66 such that the cyclic flow pattern can be prevented from occurring without creating metal to metal interference during the operation of apparatus 20. This optimization is achieved by first of all positioning one bearing support point (bearing 49 at end 51) internal to blower wheel 33 so that cantilevering effects caused by the location of output shaft 53 relative to blower wheel 33 via drive shaft 36 are virtually eliminated. Secondly, the method of coupling ring 66 to arms 43, **43*a* and 43*b* by means of rods 75, 75*a* and 75*b* means that oscillations caused by motor 37 or blower wheel 33 will occur with substantially the same frequency and with substantially the same amplitude to both ring 66 and shroud 35. The connection of ring 66 to arms 43, 43*a* and 43*b* and the connection of drive shaft 36 to tubular support column 42 cause the movement of shroud 35 and ring 66 due to motor or wheel vibration to be in phase and thereby avoid metal-to-metal interference. Finally the design of band 68 and retainer 69 accommodate slight tolerance variations between the location of ring 62, which is governed by the location of end 61 of duct member 59, and the location of ring 66, which is governed by the location of the rods. Inasmuch as motor 37 and the mechanical connections of pulleys, belts, rods and so forth are susceptible to the environment, a suitable cover panel 82 and pan 83 (see FIG. 2) are included to protect these components. Cover panel 82 seals against end 45 of enclosure 22 and pan 83 seals against cover panel 82**.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A gas-handling apparatus for transferring a gaseous substance from one location to a different location, said gas-handling apparatus comprising:

a blower assembly including an arrangement of fan blades and a drive shaft having a proximal end and a distal end, said proximal end being positioned internal to said arrangement of fan blades and attached thereto;

a drive motor having an output shaft which is coupled to said distal end of said drive shaft;

means for supporting said motor and said drive shaft including a tubular support column;

said drive shaft extending through said tubular support column and being bearingly supported within said tubular support column at a location internal to said arrangement of fan blades;

a housing enclosure surrounding said blower assembly, said enclosure having an inlet port and an outlet port, the flow of a gaseous substance from said inlet port to said outlet port passing through said arrangement of fan blades;

said supporting means further including a plurality of arm members rigidly attached to said tubular support column and hinged to said housing enclosure such that said blower assembly is pivotally movable into and out of said housing enclosure;

said arrangement of fan blades being of a generally cylindrical shape and said blower assembly further including a tapered shroud member having a larger diameter end and a smaller diameter end, said larger diameter end being joined to one end of said arrangement of fan blades;

a connecting duct member having one end attached around said inlet port and having an opposite end disposed adjacent the smaller diameter end of said shroud; and a first ring coupling connected to said arm members by means of a plurality of rods, said smaller diameter end of said shroud being disposed within said first ring coupling and positioned substantially concentric thereto.

2. The gas-handling apparatus of claim 1 which further includes a second ring coupling rigidly attached around said opposite end of said duct member, and a flexible band member mounted on said first and second ring couplings around their outer periphery and providing a seal between them.

3. The gas-handling apparatus of claim 2 which further includes a circular clamp member disposed about said flexible band member and securing it to said first and second ring couplings.

4. The gas-handling apparatus of claim 3 wherein said output shaft and said drive shaft are substantially parallel to each other and said coupling is achieved by means of a belt and two pulleys.

5. The gas-handling apparatus of claim 4 in which said blower assembly further includes a cover plate attached to the ends of said fan blades opposite said shroud and a generally frustoconical surface joined to said cover plate and positioned internal to said arrangement of fan blades, said drive shaft being rigidly attached to said generally frustoconical surface.

6. A gas-handling apparatus for transferring a gaseous substance from one location to another location, said gas-handling apparatus comprising:

a support structure including an inlet port;

a generally cylindrical arrangement of fan blades associated with said support structure;

drive means coupled to said fan blade arrangement for rotation thereof to provide a blower;

blower mounting means attached to said support structure and to said drive means and arranged to accommodate oscillation of said drive means and fan blade arrangement relative to said support structure; and inlet duct means comprising:

(a) coupling means attached to said support structure for providing a portion of an air flow path from said inlet port to said blower; and (b) a generally tapered shroud member having a larger diameter end attached to said arrangement of fan blades and a smaller diameter end positioned within said coupling means and closely spaced therefrom to substantially preclude air flow loops around said shroud, said coupling means including a first ring member attached to said blower mounting means, a second ring member attached to said support structure, and seal means, said first and second ring members being aligned with each other and sealed to each other by said seal means.

7. The gas-handling apparatus of claim 6 wherein: said inlet duct means further comprises a connecting duct having a first end attached to said support structure around said inlet port, and a second end attached to said coupling means;

said second ring member being rigidly attached to said second end of said connecting duct.

8. The gas-handling apparatus of claim 6 wherein said smaller diameter end of said tapered shroud is substantially concentric to said first ring member.

9. The gas-handling apparatus of claim 6 wherein said seal means includes an elastomeric band stretched to surround the outer periphery of said ring members, and a metal retainer is disposed over said elastomeric band and is suitably shaped so as to hold said band to said first and second ring members.

10. The gas-handling apparatus of claim 9 wherein each of said ring members has a radially extending flange portion about one end and said metal retainer has an internal trough portion, said flange portions being adjacent each other and disposed within said trough portion.

11. The gas-handling apparatus of claim 6 which further comprises:

a housing enclosure secured to said support structure and enclosing said fan blade arrangement; and means for attaching said first ring member to said blower mounting means for controlling the positional relationship between said first ring member and said smaller diameter end of said tapered shroud member.

12. The gas-handling apparatus of claim 11 wherein said blower mounting means includes a plurality of arm members mounted to said housing enclosure portion, and said attaching means for said first ring member includes a plurality of connecting rods, each of said connecting rods being attached at one end to said first ring member and being attached at the opposite end to a different arm member of said plurality of arm members.

13. The gas-handling apparatus of claim 12 which further includes a tubular support column integral with said plurality of arm members, and said drive means include a drive shaft extending through said tubular support column and bearingly supported within said tubular support column at a location internal to said arrangement of fan blades and connected to said arrangement.

14. The gas-handling apparatus of claim 13 wherein the combination of said integrally connected plurality of arm members and said tubular support column are hinged to said housing enclosure portion such that said arrangement of fan blades is pivotally movable into and out of said housing enclosure portion.

15. The gas-handling apparatus of claim 14 in which said fan blade arrangement further includes a cover plate disposed above said arrangement of fan blades and rigidly attached thereto and a frustoconical surface joined to said cover plate and positioned internal to said arrangement of fan blades, said drive shaft being rigidly attached to said frustoconical surface.

16. The gas-handling apparatus of claim 13 wherein said drive means include a drive motor mounted to said blower mounting means and having an output shaft, said output shaft and said drive shaft being substantially parallel to each other and coupled to each other by means of a belt and two pulleys.

17. The gas-handling apparatus of claim 16 wherein each of said ring members has a radially extending flange portion about one end and said metal retainer has an internal trough portion, said flange portions being adjacent each other and disposed within said trough portion; and wherein said seal means includes an elastomeric band stretched to surround the outer periphery of said ring members, and a metal retainer is disposed over said elastomeric band and is suitably shaped so as to hold said band to said first and second ring members.

* * * * *